US010199140B2

(12) United States Patent
Pourladian et al.

(10) Patent No.: US 10,199,140 B2
(45) Date of Patent: Feb. 5, 2019

(54) HIGH-POWER LOW-RESISTANCE ELECTROMECHANICAL CABLE

(71) Applicant: WireCo WorldGroup Inc., Prairie Village, KS (US)

(72) Inventors: Bamdad Pourladian, Kansas City, KS (US); Lazaro Espinosa Magaña, Cuautitlán Izcally (MX)

(73) Assignee: WireCo Worldgroup Inc., Prairie Village, KS (US)

( * ) Notice: Subject to any disclaimer, the term of this patent is extended or adjusted under 35 U.S.C. 154(b) by 0 days.

(21) Appl. No.: 15/489,341

(22) Filed: Apr. 17, 2017

(65) Prior Publication Data

US 2017/0221603 A1 Aug. 3, 2017

Related U.S. Application Data

(62) Division of application No. 14/261,089, filed on Apr. 24, 2014, now Pat. No. 9,627,100.
(Continued)

(51) Int. Cl.

| | |
|---|---|
| ***H01B 7/00*** | (2006.01) |
| ***H01B 7/04*** | (2006.01) |
| ***H01B 13/00*** | (2006.01) |
| ***H01B 9/00*** | (2006.01) |
| ***D07B 1/14*** | (2006.01) |
| ***H01B 11/22*** | (2006.01) |

(52) U.S. Cl.
CPC ..... *H01B 7/046* (2013.01); *D07B 1/147* (2013.01); *H01B 9/005* (2013.01); *H01B 11/22* (2013.01); *H01B 13/0006* (2013.01); *H01B 7/0009* (2013.01)

(58) Field of Classification Search
CPC ... H01B 7/00; H01B 7/02; H01B 7/04; H01B 7/14; H01B 7/17; H01B 7/18; H01B 7/29; H01B 7/32; H01B 7/046; H01B 7/182; H01B 7/221; H01B 9/02; H01B 9/03; H01B 11/02; E21B 23/14
USPC ... 174/70 R, 102 R, 103, 103 R, 106 R, 107, 174/108, 113 R, 115, 120 R, 121 A; 166/335, 385; 156/296
See application file for complete search history.

(56) References Cited

U.S. PATENT DOCUMENTS 2,180,731 A 11/1939 Dickinson
3,348,183 A 10/1967 Hodges et al.
(Continued)

*Primary Examiner* — Xiaoliang Chen
(74) *Attorney, Agent, or Firm* — Husch Blackwell LLP

(57) ABSTRACT

A high-power low-resistance electromechanical cable constructed of a conductor core comprising a plurality of conductors surrounded by an outer insulating jacket. Each conductor has a center conductor element surrounded by a plurality of copper wires, wherein the plurality of copper wires is compacted to have a non-circular cross-section. The center conducting element may be one of a fiber optic strand, a copper wire having an indented outer surface, or a twisted conductor pair. Each conductor also includes a conductor insulating jacket encapsulating the plurality of copper wires and center conducting element. A first armoring layer of a plurality of strength members is wrapped around the outer insulating jacket. A second armoring layer of a plurality of strength members may also be wrapped around the first layer. A polymer jacket layer may encapsulate the first and/or second armoring layers of strength members.

11 Claims, 5 Drawing Sheets

Related U.S. Application Data

(60) Provisional application No. 61/815,596, filed on Apr. 24, 2013.

(56) References Cited

U.S. PATENT DOCUMENTS 3,614,300 A 10/1971 Wilson
3,699,238 A 10/1972 Hansen et al.
3,742,363 A 6/1973 Carle
3,784,732 A * 1/1974 Whitfill, Jr. ..... B29C 63/00 174/108
4,006,289 A 2/1977 Roe et al.
4,018,977 A 4/1977 Hermann, Jr. et al.
4,034,547 A * 7/1977 Loos ..... D07B 1/0693 57/211
4,078,853 A 3/1978 Kempf et al.
4,081,602 A 3/1978 Paniri et al.
4,199,224 A 4/1980 Oestreich
4,272,155 A 6/1981 Slaughter
4,329,539 A 3/1982 Tanaka et al.
4,440,974 A * 4/1984 Naudet ..... H01B 7/04 174/108
4,473,936 A 10/1984 Kellner et al.
4,521,072 A * 6/1985 Cholley ..... G02B 6/4407 385/101
4,522,464 A 6/1985 Thompson et al.
4,523,804 A 6/1985 Thompson
4,552,989 A 11/1985 Sass
4,595,793 A 6/1986 Arroyo et al.
4,605,818 A 8/1986 Arroyo et al.
4,606,604 A * 8/1986 Soodak ..... G02B 6/4416 385/101
4,621,169 A 11/1986 Petinelli et al.
4,623,218 A 11/1986 Laurette et al.
4,641,110 A * 2/1987 Smith ..... H01B 11/10 174/36
4,675,474 A 6/1987 Neuroth
4,696,542 A * 9/1987 Thompson ..... D07B 1/0693 385/107
4,719,319 A 1/1988 Tighe, Jr.
4,780,574 A 10/1988 Neuroth
4,787,702 A * 11/1988 Khalil ..... G02B 6/441 385/102
4,787,705 A 11/1988 Shinmoto et al.
4,813,754 A 3/1989 Priaroggia
4,843,696 A 7/1989 Gentry et al.
4,896,940 A 1/1990 Kathiresan et al.
4,936,647 A * 6/1990 Carroll ..... D07B 1/068 174/128.1
4,952,012 A * 8/1990 Stamnitz ..... G02B 6/4416 385/101
4,956,523 A 9/1990 Pawluk
4,971,420 A * 11/1990 Smith ..... G02B 6/4401 385/107
4,997,992 A 3/1991 Low
5,042,903 A * 8/1991 Jakubowski ..... G02B 6/4415 385/101
5,073,682 A 12/1991 Walling et al.
5,125,061 A * 6/1992 Marlier ..... G02B 6/4416 174/70 R
5,125,062 A * 6/1992 Marlier ..... G02B 6/4416 174/70 R
5,150,443 A * 9/1992 Wijnberg ..... E21B 17/206 174/106 R
5,153,381 A 10/1992 Ganatra et al.
5,189,719 A 2/1993 Coleman et al.
5,195,158 A 3/1993 Bottoms, Jr. et al.
5,204,926 A 4/1993 Bottoms, Jr. et al.
5,229,851 A 7/1993 Rahman
5,268,971 A 12/1993 Nilsson et al.
5,274,725 A 12/1993 Bottoms, Jr. et al.
5,317,665 A 5/1994 Herrebrugh
5,455,881 A 10/1995 Bosisio et al.
5,493,626 A 2/1996 Schultz et al.
5,495,547 A * 2/1996 Rafie ..... E21B 17/206 340/854.7
5,502,287 A 3/1996 Nguyen
5,739,472 A 4/1998 Buck et al.
5,739,473 A * 4/1998 Zerbs ..... H01B 7/295 174/110 PM
5,808,239 A 9/1998 Olsson
5,905,834 A 5/1999 Anderson et al.
6,058,603 A 5/2000 Reed
6,060,662 A * 5/2000 Rafie ..... E21B 17/206 174/106 R
6,069,841 A 5/2000 Johnston
6,088,499 A 7/2000 Newton et al.
6,099,961 A 8/2000 Del Vecchio et al.
6,127,632 A * 10/2000 Oswald ..... H01B 7/046 174/120 R
6,140,587 A 10/2000 Sackett
6,160,938 A * 12/2000 Little, Jr. ..... G02B 6/04 385/103
6,195,487 B1 2/2001 Anderson et al.
6,199,266 B1 3/2001 Meserve
6,236,789 B1 5/2001 Fitz
6,255,594 B1 7/2001 Hudson
6,297,455 B1 * 10/2001 Wijnberg ..... H01B 7/046 174/113 R
6,331,676 B1 * 12/2001 Gutierrez ..... H01B 7/0009 174/128.1
6,365,838 B1 * 4/2002 Rutledge ..... H01B 7/0009 174/128.1
6,392,151 B1 * 5/2002 Rafie ..... E21B 17/206 174/106 R
6,448,500 B1 * 9/2002 Hosaka ..... H01B 9/003 174/113 R
6,449,834 B1 9/2002 Bales, Jr. et al.
6,463,198 B1 10/2002 Coleman et al.
6,469,636 B1 10/2002 Baird et al.
6,600,108 B1 * 7/2003 Mydur ..... H01B 7/046 174/120 R
6,631,095 B1 10/2003 Bryant et al.
7,119,283 B1 * 10/2006 Varkey ..... H01B 7/2806 174/102 R
7,763,802 B2 7/2010 Varkey et al.
7,985,925 B2 7/2011 Fischer et al.
2002/0001441 A1 * 1/2002 Avellanet ..... G02B 6/4416 385/104
2003/0106704 A1 * 6/2003 Isley ..... H01B 11/04 174/113 R
2003/0141097 A1 7/2003 Belli et al.
2004/0045735 A1 * 3/2004 Varkey ..... H01B 3/441 174/120 R
2004/0124001 A1 7/2004 Sanders
2004/0267385 A1 * 12/2004 Lingemann ..... G05B 15/02 700/83
2005/0036750 A1 * 2/2005 Triplett ..... G02B 6/4495 385/100
2005/0045365 A1 3/2005 Bladh et al.
2005/0061533 A1 3/2005 Lovoi et al.
2005/0078922 A1 4/2005 Sanders et al.
2005/0129942 A1 6/2005 Hiel et al.
2005/0219063 A1 * 10/2005 Viswanathan ..... G01V 1/52 340/854.9
2006/0072886 A1 4/2006 Kim et al.
2006/0162951 A1 7/2006 Ashibe et al.
2006/0231286 A1 * 10/2006 Varkey ..... H01B 7/1895 174/113 R
2006/0237219 A1 * 10/2006 Glew ..... H01B 7/0892 174/113 C
2006/0237220 A1 10/2006 Leyendecker
2006/0242824 A1 11/2006 Varkey et al.
2006/0280412 A1 12/2006 Varkey
2007/0044993 A1 * 3/2007 Varkey ..... H01B 7/1895 174/102 R
2007/0081773 A1 4/2007 Pizzorno et al.
2007/0107928 A1 * 5/2007 Varkey ..... H01B 7/046 174/102 R
2007/0158095 A1 * 7/2007 Sridhar ..... G01V 1/201 174/106 R

(56) References Cited

U.S. PATENT DOCUMENTS

2008/0031578 A1 2/2008 Varkey et al.
2008/0185138 A1* 8/2008 Hernandez-Solis .... E21B 36/04 166/60
2008/0218375 A1* 9/2008 Viswanathan ..... G01V 1/52 340/854.9
2008/0236867 A1* 10/2008 Varkey ..... H01B 7/046 174/115
2008/0289851 A1* 11/2008 Varkey ..... G02B 6/4416 174/115
2008/0293575 A1 11/2008 Hirose et al.
2009/0120663 A1 5/2009 Karlsen et al.
2009/0139744 A1* 6/2009 Varkey ..... H01B 7/046 174/113 R
2009/0145610 A1* 6/2009 Varkey ..... E21B 17/206 166/335
2009/0283295 A1* 11/2009 Varkey ..... H01B 7/046 174/105 R
2010/0116510 A1* 5/2010 Varkey ..... E21B 47/123 166/385
2010/0218970 A1 9/2010 Eshima
2010/0316340 A1 12/2010 Sales Casals et al.
2011/0209892 A1* 9/2011 Metz ..... H01B 11/1843 174/102 R
2011/0253414 A1 10/2011 Dewberry et al.
2011/0278062 A1 11/2011 Varkey
2011/0297418 A1 12/2011 Temblador
2012/0082422 A1 4/2012 Sarchi et al.
2012/0097419 A1* 4/2012 Varkey ..... H01B 7/046 174/106 R
2012/0174683 A1 7/2012 Kemnitz et al.
2012/0222869 A1* 9/2012 Varkey ..... E21B 23/14 166/385
2012/0292079 A1* 11/2012 Muramatsu ..... A61B 1/00018 174/113 R
2013/0206314 A1* 8/2013 Varkey ..... H01B 7/292 156/52
2013/0287348 A1* 10/2013 Register ..... H01B 11/22 385/101
2014/0003775 A1 1/2014 Ko et al.
2014/0049786 A1 2/2014 Knuepfer et al.
2014/0064680 A1 3/2014 Register, III et al.
2014/0064681 A1 3/2014 Register, III et al.
2014/0367121 A1 12/2014 Varkey et al.

* cited by examiner

HIGH-POWER LOW-RESISTANCE ELECTROMECHANICAL CABLE

CROSS-REFERENCE TO RELATED APPLICATIONS

This Application is a Divisional of and claims priority to U.S. application Ser. No. 14/261,089, filed on Apr. 24, 2014, to Bamdad Pourladian and Lazaro Espinosa Magaña entitled "High-Power Low-Resistance Electromechanical Cable," currently pending, which claims priority to U.S. Provisional Patent Application Ser. No. 61/815,596, filed on Apr. 24, 2013, entitled "High-Power Low-Resistance Electromechanical Cable,", the entire disclosure of which is incorporated herein by reference.

BACKGROUND OF THE INVENTION

Electromechanical cables are used in oil and gas well logging and other industrial applications. Electromechanical cables provide an electrical power supply for down-hole instruments that record and sometimes transmit information to the surface ("Instrument Power"). Instrument power is usually steady-state, meaning that the power levels are substantially constant during a logging run. Some logging tools, however, also require additional and simultaneous power to operate transmitters ("Auxiliary Power"). The Auxiliary Power may also be used to operate down-hole motors on an intermittent basis. One example is calipers that are operated by a user on the surface or automatically by the logging system that are intermittently operated to obtain measurements or samples of the properties of a bore-hole.

The amount of electric current transmitted through the electromechanical cable that is actually received by the down-hole tools is dependent upon many factors, including the conductivity of the material, the electrical resistance of the material, and the cross-sectional area of the conductive material. Often, an electromechanical cable loses electrical energy through heat dissipation generated by the resistive effect of the copper conductors. It is common that in order to deliver a power "P" to the down-hole tools, a power of 2 P must be input into the system because P power is lost due to dissipation of heat due to resistance of the conductor over the entire length of the conductor. The generation of resistive heat poses a problem and significantly limits the amount of current fed through the electromechanical cable, particularly when the electromechanical cable is stored on a drum during use. When the excess electromechanical cable is stored on a drum during operation, the heat has little ability to dissipate into the atmosphere or surrounding environment due to the fact that many layers of cable may be overlapped and the heat has an additive effect. Therefore, care must be taken to avoid over heating the cable because the conductor may short-circuit or otherwise become dangerous if the internal temperature of the cable rises above a temperature that softens or melts the insulating polymer layer surrounding the wire. It is often the heat build up during storage on the drum during operation that limits the amount of power that can be delivered by an electromechanical cable to the down-hole tools. For example, a 7/16" diameter cable may usually withstand ¼ to ⅓ of a watt per foot of power dissipation without overheating. This limits the power input into the cable to that which will not cause over the ¼ to ⅓ watt per foot power dissipation. The loss of energy resulting from heat dissipation due to the resistance of the conductor is undesirable especially in applications where the cable is being used for periods of longer than several minutes at a time.

Therefore, there is a need in the art to reduce the resistance of a conductor in order to allow more power to be transferred through it while reducing or maintaining the same or less heat generation. One way to reduce the resistance and increase the power is to increase the diameter of the conductor. However, this necessarily increases the weight of the cable thereby introducing additional weight that (1) the cable itself must support and/or (2) requiring adjustment of the existing trucks in order to convey, transport, and utilize the larger diameter cable. Further, because of the increase in horizontal drilling in the industry, the length of bore holes has become longer, requiring longer lengths of electromechanical cable to supply power, the horizontal drilling necessitates the use of certain "tractor" devices to push or pull tools inside the wellbore. The tractors must pull the length of the electromechanical cable in the horizontal portion of the well as well as the other tools through the bore hole and, therefore, there is also a need in the art to reduce the weight of the electromechanical cable in addition to decreasing the resistance of the copper conductor. A lighter weight cable will also contribute to making logging of oil and gas wells more efficient by saving energy demanded by the down-hole tools themselves because more energy is required to power the tractor when it must move a heavier cable Thus, there is a substantial need in the art for an electromechanical cable having (1) a lower electrical resistance that efficiently delivers power to down-hole tools, and (2) is lighter weight than conventional electromechanical cables.

SUMMARY

One embodiment of the present invention is directed to a high-power low-resistance electromechanical cable. The cable has a conductor core comprising a plurality of conductors surrounded by an outer insulating jacket and with each conductor having a plurality of wires that are surrounded by an insulating jacket. The wires can be copper or other conductive wires. The insulating jacket surrounding each set of wires or each conductor can be comprised of ethylene tetrafluoroethylene (ETFE), polytetrafluoroethylene (PTFE), PTFE tape, perfluoroalkoxyalkane (PFA), fluorinated ethylene propylene (FEP) or a combination of two different layers or materials. A first layer of a plurality of strength members is wrapped around the outer insulating jacket. The strength members can be either steel or synthetic fiber. A second layer of a plurality of strength members may be wrapped around the first layer of strength members. The second layer of strength members can be made of steel or synthetic fiber. If either or both layers are made up of synthetic fiber, then the synthetic fibers may be surrounding and encapsulated by an additional insulating and protective layer. In addition, the strength members can be either a single wire, synthetic fiber strands, multiwire strands, or rope.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views, and wherein.

DETAILED DESCRIPTION OF THE INVENTION

Figure 1:
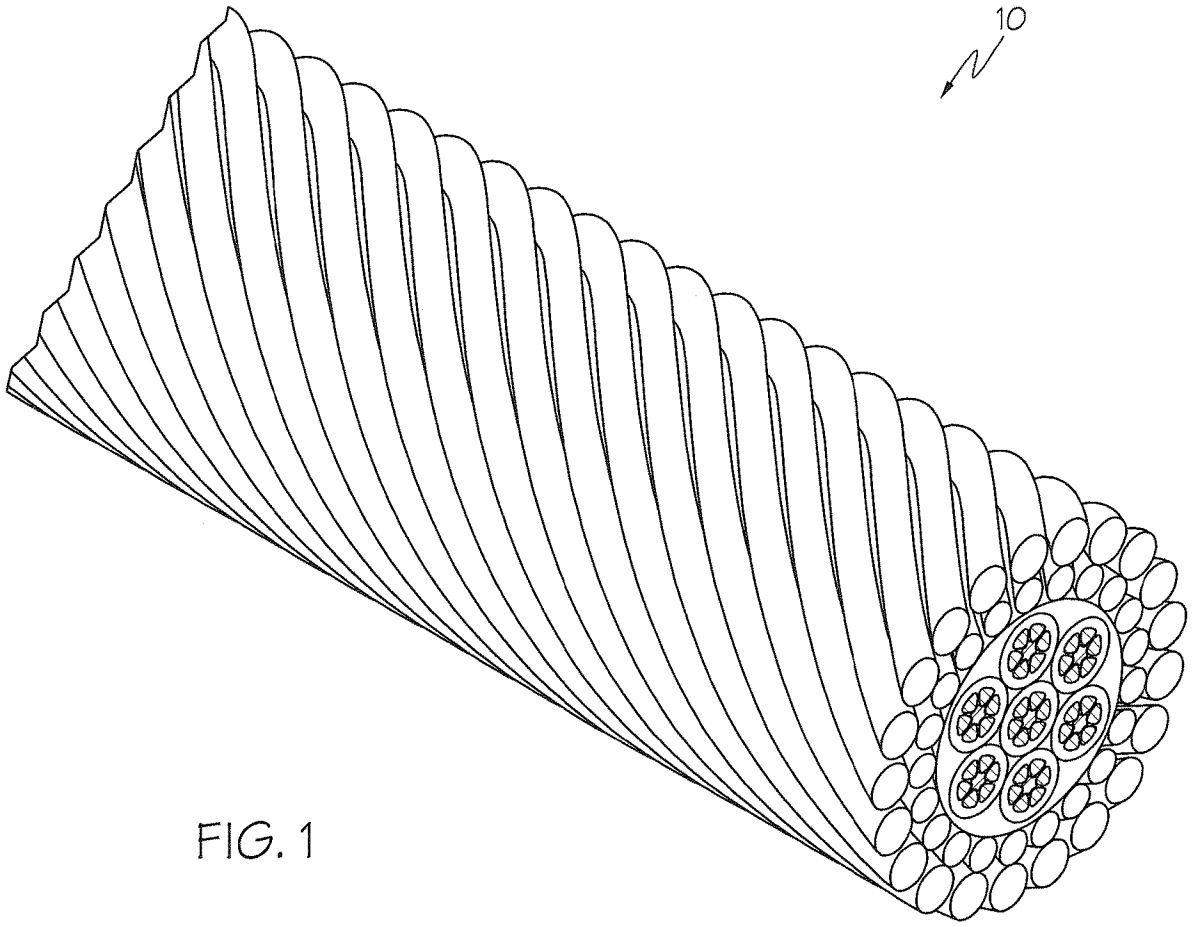
FIG. 1 is a side view of one embodiment of an electromechanical cable in accordance with the teachings of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and, therefore, the description is not to be taken in a limiting sense and shall not limit the scope of equivalents to which such claims are entitled.

Figure 2:
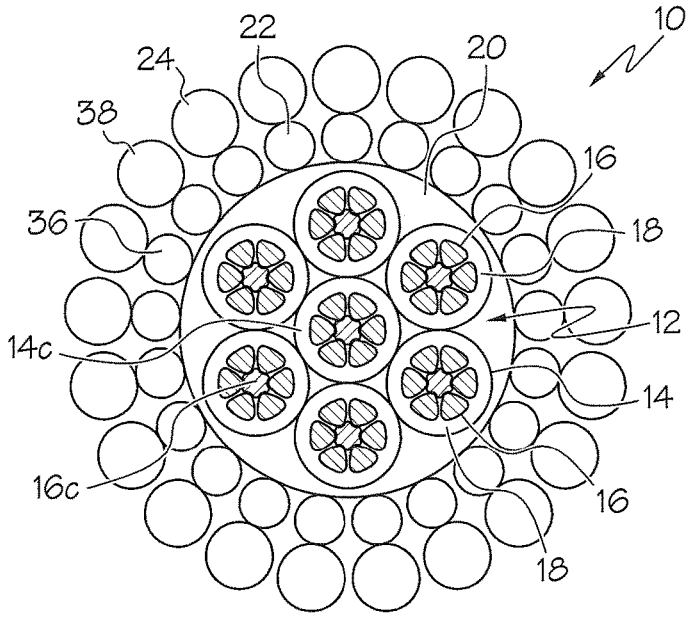
FIG. 2 is a cross-section view of one embodiment of an electromechanical cable in accordance with the teachings of the present invention.

A high-power low-resistance electromechanical cable 10 embodying various features of the present invention is shown in FIG. 1. As illustrated in FIG. 2, the present invention is directed toward electromechanical cable 10 comprising a conductor core 12 having a plurality of conductors 14. Each conductor 14 comprises a plurality of wires 16 with conductive properties, such as copper wires, surrounded by an insulator jacket 18. Plurality of conductors 14 are enclosed in a conductor jacket 20 and at least a first armoring layer 22 of a plurality of strength members 36 are helically wrapped around conductor jacket 20. One embodiment further includes a second armoring layer 24 of a plurality of strength members 38 helically wrapped around first layer 22.

Figure 3:
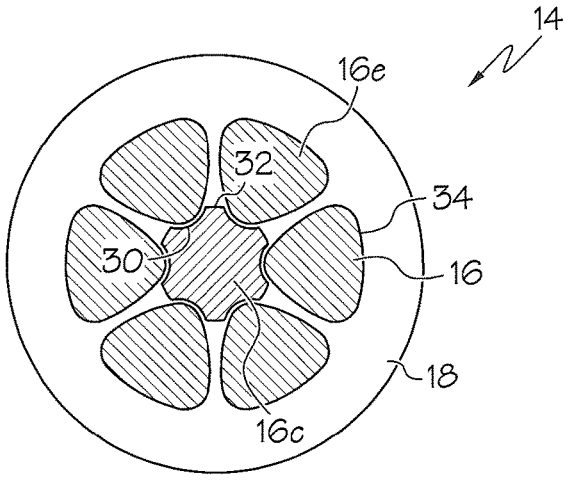
FIG. 3 is a cross-section view of one embodiment of an electromechanical cable in accordance with the teachings of the present invention.

As shown in FIG. 1, one embodiment of conductor core 12 comprises seven (7) conductors 14 configured such that six (6) conductors are wrapped around a center conductor 14*c*. However, any number or configuration of conductors now known or hereafter developed may be used depending upon the power requirements and the size of the bore hole or other requirements of the particular application. As shown in FIGS. 2 and 3, each conductor 14 comprises seven (7) wires 16 and wherein six (6) wires 16 are wrapped around a center wire 16*c* as shown. Wires 16 are constructed of copper and surrounded by insulator jacket 18. Insulator jacket 18 can be comprised of ethylene tetrafluoroethylene (ETFE), polytetrafluoroethylene (PTFE), ePTFE tape produced by Gore®, perfluoroalkoxyalkane (PFA), fluorinated ethylene propylene (FEP) or a combination of two jacket layers of materials. However, any insulating material now known or hereafter developed may be used.

Prior to applying insulator jacket 18 to plurality of wires 16, wires 16 are compacted to smooth or flatten the outer surface of plurality of wires 16. As shown in FIG. 3, the compaction step significantly deforms the cross-section of the originally round plurality of wires 16 into a generally "D" or triangular shape wherein each exterior wire 16*e* has a rounded exterior face 34. Compaction reduces the voids between wires 16 thereby creating a more dense distribution of wires in conductor 14. As further shown in FIG. 3, compaction of wires 16 may significantly indent a portion 30 of an outer surface 32 of center wire 16*c*. After plurality of wires 16 are compacted, insulator jacket 18 can be applied to encapsulate plurality of wires 16 by co-extruding insulator jacket 18 over plurality of wires 16. Alternatively, any other method of applying an insulator layer to plurality of wires 16 now known or hereafter developed may be used in this invention.

Additional methods of insulating plurality of wires 16 include (1) wrapping Gore's ePTFE tape material over plurality of wires 16, or (2) ram-extrusion of PTFE material over plurality of wires 16. Plurality of wires 16 are preferably copper, however, any conductive metal now known or hereafter developed having similar or better conductive properties. Silver or silver coated copper can also be used. Furthermore, plurality of wires 16 may be any diameter required to carry the desired electric load. For example, one embodiment includes a 7-conductor 14 cable 10 having an overall diameter of one-half inch (0.5"), each conductor 14 comprising seven (7) plurality of wires 16 made of copper, wherein the 7-wire copper strand before insulator jacket 18 is applied has a diameter after compaction of about 0.0480 inch.

Figure 5:
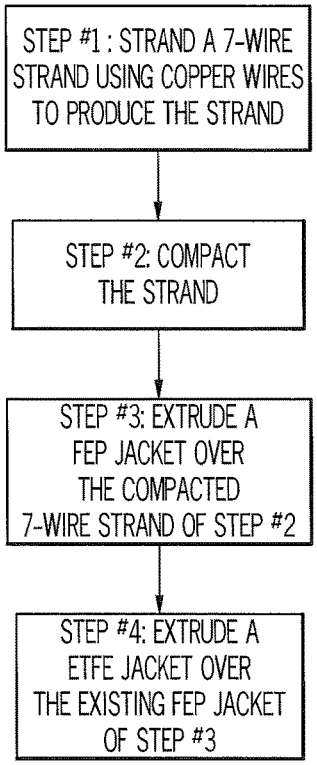
FIG. 5 is a flow chart illustrating the steps for compacted 7-wire conductor core as shown in FIG. 4.

Referring to FIG. 5, the steps for producing conductor 14 of one embodiment is shown. Seven wires 16 made of copper and 0.0193" inch diameter are stranded to produce a 0.0579" inch strand and are then compacted (shown in FIG. 3). A 0.011" inch thick FEP jacket is extruded over the compacted strand and a 0.011" inch thick ETFE jacket is extruded over the FEP jacket. The FEP jacket and the ETFE jacket make up insulator jacket 18 as shown in FIG. 3.

As a person of skill in the art will appreciate, the diameter of the wires will be dependent upon (1) the number of wires in a conductor, (2) the number of conductors in the cable, and (3) the overall diameter of the cable. The lay length or lay angle of the copper wires in the 7-wire strand also determines the required wire size. The thickness of insulation materials 20 and 28 also determine the size of the compacted 7-wire strand. Common diameters of copper wires used in conductors range from 0.010 inch to 0.020 inch.

Turning back to FIG. 2, plurality of conductors 14 are orientated within conductor core 12. The embodiment shown includes seven (7) conductors 14. In this embodiment, six (6) conductors 14 are helically wrapped around center conductor 14*c*. However, a person of skill in the art will appreciate that other common numbers of plurality conductors 14 may be used. Conductor core 12 often includes the number of conductors in a range from 1-10 depending upon the down-hole requirements and overall diameter of the cable needed. However, any number of conductors is within the scope of the present invention. As further shown, one embodiment of conductor core 12 includes plurality of conductors 14 being encapsulated by an outer insulator layer 20. Outer insulator layer 20 can be comprised of ethylene tetrafluoroethylene (ETFE), polytetrafluoroethylene (PTFE), fluorinated ethylene propylene (FEP), or perfluoroalkoxyalkane (PFA).

As shown in FIG. 2, cable 10 further comprises at least first armoring layer 22 of a plurality of strength members 36 helically wrapped around conductor core 12 and some embodiments can include a second armoring layer 24 of a plurality of strength member 38 helically wrapped around first armoring layer 22. First armoring layer 22 (and second armoring layer 24) protect conductor core 12 and provide the load carrying capacity of cable 10. First strength members 36 of first armoring layer 22 can have a different or the same diameter as second strength members 38 of second armoring layer 24.

Figure 4:
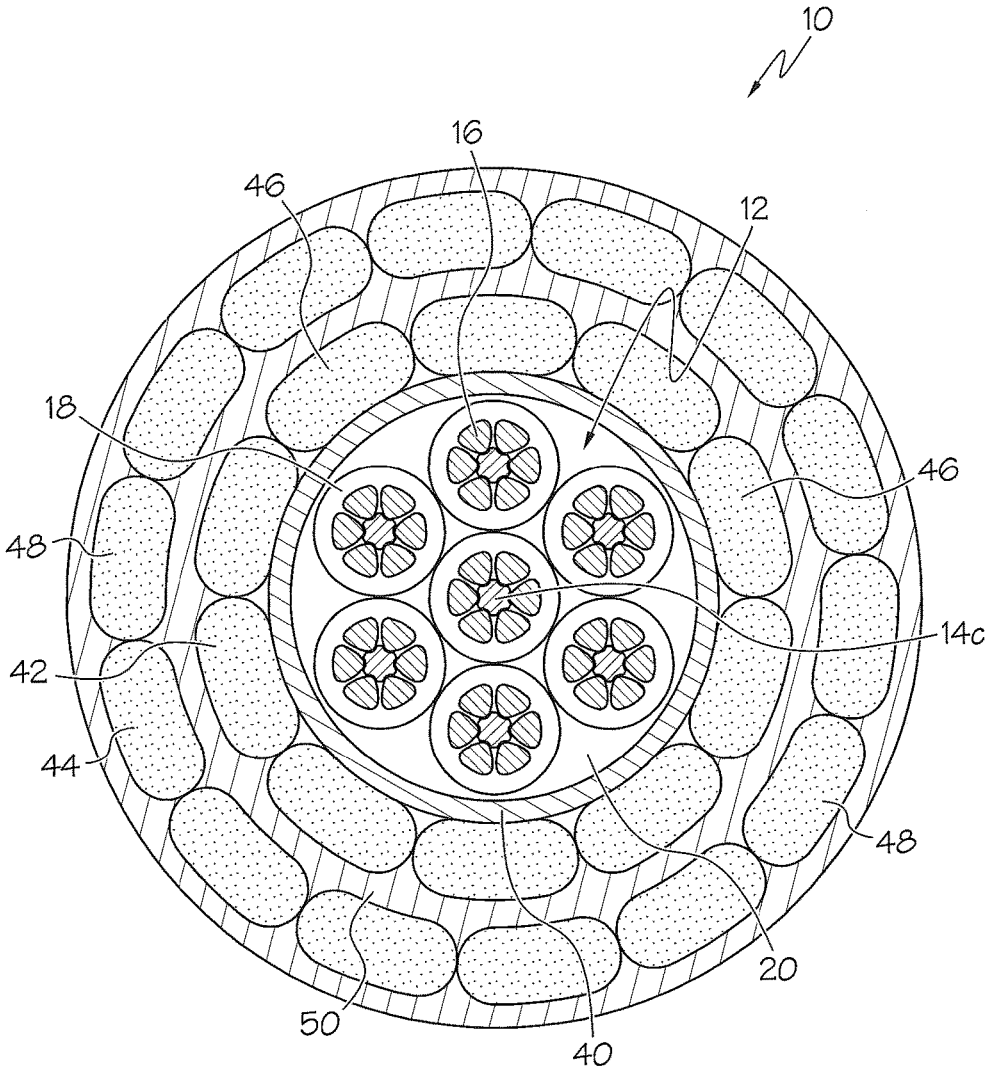
FIG. 4 is a cross section view of one embodiment of an electromechanical cable in accordance with the teachings of the present invention having a 7-wire compacted core with light-weight synthetic fiber strength members encased in a plastic jacket.

In one embodiment, second strength members 38 may have a larger diameter than the first strength members 36. First and second strength members 36, 38 can be single wire, synthetic fiber strands multi-wire strands or rope, or a combination thereof. Synthetic strands are substantially lighter than steel or other metal wires for a similar tensile strength; therefore, it may be desirable to reduce the overall weight of the cable by using a synthetic fiber (as shown in FIG. 4 and further described herein). However, if the cable will be subject to substantial abrasion or requires a more durable armoring, then conventional steel or aluminum wires may be wrapped around conductor core 12. First strength members 36 and second strength members 38 can be wrapped in opposite directions (i.e., one lays right, the other lays left) to contribute to cable 10 being torque-balanced.

In another embodiment, first and second strength members 36, 38 are made of steel wires which provide both strength and abrasion resistance. This embodiment includes first and second strength members 36, 38 having a diameter between one-half (0.5) and seven (7) millimeters. However, any wire diameter known in the art is within the scope of the present invention. First and second strength members 36, 38 can be high-strength steel wires having an ultimate tensile strength in a range between about fifteen hundred (1500) MPa and about three thousand five hundred (3500) MPa. First and second strength members 36, 38 can also be galvanized or stainless steel, or any metal or alloy that provides desired traits for the environment in which cable 10 is to be used.

FIG. 2 illustrates an embodiment of cable 10 having an overall diameter of about one-half inch (½"). In this embodiment, first armoring layer 22 includes about twenty-one (21) first strength members 36 each strength member having a diameter of about 0.0470 inches (1.2 mm) and an average breaking strength of about six-hundred thirty (630) pounds (2500 Mpa). Further, this embodiment includes a second armoring layer 24 having about twenty-two (22) second strength members 38, each strength member or wire 38 having a diameter of about 0.0585 inches (1.5 mm) and an average breaking strength of about nine-hundred seventy-five (975) pounds (2500 Mpa).

In one alternative embodiment as represented in FIG. 4, cable 10 has conductor core 12 that is made as described previously herein. Conductor core 12 is encapsulated by conductor jacket 20. Conductor jacket 20 is encapsulated by a second insulating layer 40. Second insulating layer 40 is wrapped with an inner layer 42 of a plurality of synthetic fibers 46 and an outer layer 44 of a plurality of synthetic fibers 48 wrapped around inner layer 42. Inner layer 42 and outer layer 44 have a jacket 50 surrounding and encapsulating inner layer 42 and outer layer 44, which includes an inner surface and an outer surface that defines a material thickness. Jacket 50 encapsulates both inner and outer layers 42, 44 substantially along the entire length of electromechanical cable 10. The jacket material can be made of ETFE, PEEK, PVDF, or any other abrasion resistant polymer suitable for high temperature oil and gas well application.

Plurality of synthetic fibers 46, 48 are comprised of one or a combination of high-strength synthetic fibers. Any high-strength and high modulus of elasticity synthetic fiber may be used including Aramid fiber such as Kevlar® and Technora®, liquid-crystal polymer fibers such as Vectran®, ultra high molecular weight polyethylene such as Spectra and Dyneema®, PBO fibers such as Zylon®, or any other high strength synthetic fiber now known or hereafter developed.

In one embodiment, plurality of synthetic fibers 46 of inner layer 42 are twisted at a lay angle in a range between about one and about twenty degrees (1°-20°). One embodiment includes synthetic fibers plurality of 46 of inner layer 42 having a lay angle of about two degrees (2°). Another embodiment includes synthetic fiber strands having a lay angle of about eleven degrees (11°). In another embodiment where the highest axial stiffness is desired for the final electromechanical cable, the lay angle may be zero degrees (0°). Plurality of synthetic fibers 46, 48 can be configured to lay to the right or to the left. Plurality of synthetic fibers 46 of inner layer 42 can have an opposite lay angle of plurality of synthetic fibers 48 of outer layer 44.

Figure 6:
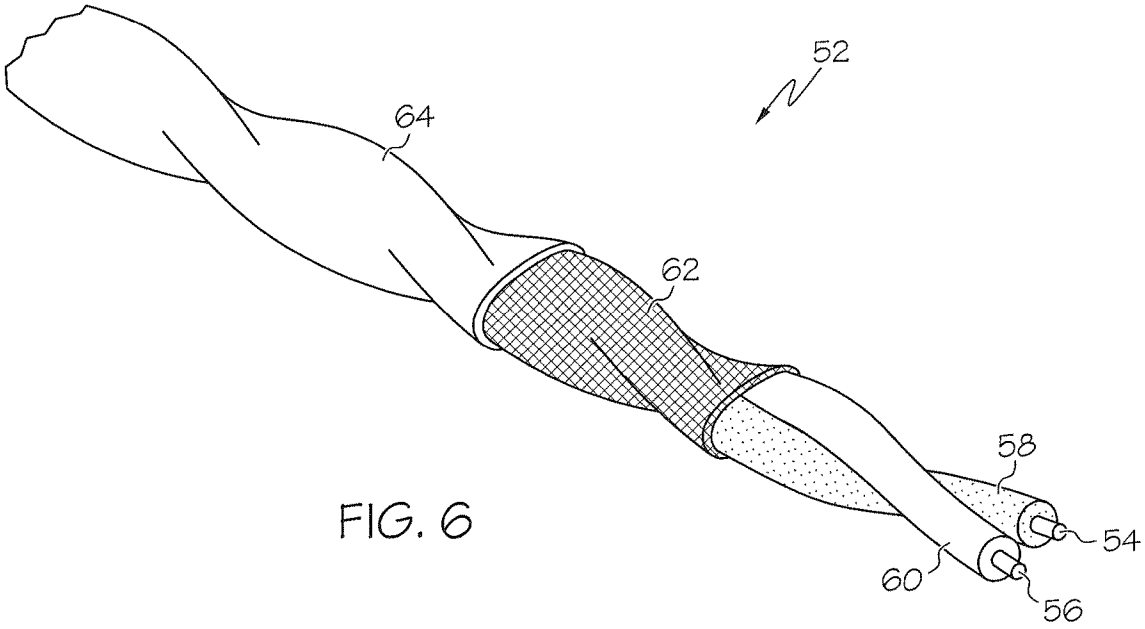
FIG. 6 is a twisted pair of conductors used to replace one or more of the wire mono-conductors of shown in FIGS. 2 and 4.

Alternatively, as shown in FIG. 6, any one of plurality of conductors 14 of conductor core 12 can be replaced with a twisted paired conductor 52. Paired conductor 52 has two conductors 54, 56, each of which are silver-plated copper or an alloy. Each conductor 54, 56 is insulated with PTFE or ePTFE. Conductors 54, 56 are twisted together and encased in a braided silver-plated wire shield 62. A jacket 64 made of ETFE fluoropolymer covers shield 62.

Alternatively, in one embodiment not shown in the drawings, any one of plurality of conductors 14 of conductor core 12 can be replaced with a fiber optic component for better signal processing. The fiber optic component can be comprised of fiber in metal tubing and can be encapsulated in a PEEK jacket or other high toughness and abrasion resistant polymers for applications in which a lighter than stainless-steel tube is desired.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A high-power low-resistance electromechanical cable comprising:

a conductor core comprising a plurality of conductors substantially encapsulated by a first insulating jacket, and wherein each conductor of said plurality of conductors comprises six copper wires wrapped around a center conducting element and a conductor insulated jacket encapsulating said six copper wires and said center conducting element, wherein said six copper wires are compacted around said center conductor element prior to being encapsulated by said conductor insulated jacket resulting in said six copper wires having a non-circular cross-section, wherein said center conductor element comprises a copper conductor wire having an indented outer surface due to the compaction of said six copper wires; and a first armoring layer comprised of a first plurality of strength members helically wrapped around said first insulating jacket, and a second armoring layer comprised of a second plurality of strength members helically wrapped around said first armoring layer of strength members.

2. The cable of claim 1 wherein said center conductor element comprises at least one fiber optic strand.

3. The cable of claim 1 wherein said center conductor element comprises one or more twisted paired conductor strands.

4. The cable of claim 1 wherein said first plurality and said second plurality of strength members are steel.

5. The cable of claim 4 wherein said first plurality of steel strength members is one of a single wire, a multi-wire strand, or a rope, and said second plurality of steel strength members is one of a single wire, a multi-wire strand, or a rope.

6. The cable of claim 1 wherein said first plurality of strength members comprises high-strength synthetic fibers and said second plurality of strength members comprises high-strength synthetic fibers.

7. The cable of claim 6 wherein said second armoring layer of strength members is surrounded and substantially encapsulated by a polymer layer.

8. The cable of claim 1 wherein said second armoring layer of strength members is surrounded and substantially encapsulated by a polymer layer.

9. The cable of claim 1 wherein a second insulating jacket encapsulates said first insulating jacket and is disposed between said first armoring layer and said first insulating jacket.

10. The cable of claim 9 wherein each of said first insulating jacket and said second insulating jacket is one of ethylene tetrafluoroethylene, polytetrafluoroethylene, polytetrafluoroethylene tape, perfluoroalkoxyalkane, fluorinated ethylene propylene or a combination thereof.

11. The cable of claim 10 wherein the first insulating jacket is a different material than said second insulating jacket.

* * * * *